United States Patent [19]

Hashimoto et al.

[11] Patent Number: 4,593,548

[45] Date of Patent: Jun. 10, 1986

[54] METHOD OF CORRECTING DISTORTIONS IN A ROLLED STRIP PRODUCT

[75] Inventors: Kazuyoshi Hashimoto; Toshihiro Takemasa; Nobuyuki Taniguchi, all of Hiroshima, Japan

[73] Assignee: Mitsubishi Jukogyo Kabushiki Kaisha, Tokyo, Japan

[21] Appl. No.: 749,227

[22] Filed: Jun. 27, 1985

[30] Foreign Application Priority Data

Jul. 6, 1984 [JP] Japan ..... 59-138980

[51] Int. Cl.[4] ..... B21B 37/00

[52] U.S. Cl. ..... 72/12; 72/161

[58] Field of Search ..... 72/11, 12, 21, 161

[56] References Cited

U.S. PATENT DOCUMENTS

| | | | |
|---|---|---|---|
| 3,543,548 | 12/1970 | Smith | 72/11 |
| 4,011,743 | 3/1977 | Peterson | 72/12 |
| 4,232,369 | 11/1980 | Fukushima | 72/71 |
| 4,335,435 | 6/1982 | Miara | 72/12 |
| 4,400,957 | 8/1983 | Carlstedt | 72/12 |
| 4,539,830 | 9/1985 | Noe | 72/12 |
| 4,551,805 | 11/1985 | Shimoda | 72/11 |

*Primary Examiner*—Leon Gilden

*Attorney, Agent, or Firm*—Birch, Stewart, Kolasch & Birch

[57] ABSTRACT

A method of correcting distortions existing in a rolled strip product by using a tension leveling equipment including a leveling mill station for smoothing out distortions remained in the strip product by producing a permanent elongation through the repetition of bending procedures rendered upon the strip while passing under tension therethrough, a pair of bridle units disposed on the both input and output sides of the leveling mill station, and means for rendering a tension upon the strip from a predetermined rate of elongation under the effect of a difference in the feeding velocities of the bridle units, which comprises the steps of detecting the distortions in the shape of the strip product upon the delivery thereof from the output bridle unit, obtaining detection signals, and controlling the rate of intermeshing in the leveling mill station and the rate of elongation of the strip product to a required range in accordance with the detection signals. With this improved method, it can afford a high precision correction of distortions in the strip product, following closely the possible fluctuations in the physical conditions which are generally particular to the strip product, thus making it possible in practice to obtain a high-quality strip product, accordingly.

2 Claims, 2 Drawing Figures

METHOD OF CORRECTING DISTORTIONS IN A ROLLED STRIP PRODUCT

BACKGROUND OF THE INVENTION (i) Field of the Invention

The present invention relates to the improvement in or relating to the method of correcting a deformation left in the rolled-down strip product such as a cold rolled steel strip, etc. (hereinafter referred to as "the strip product") by way of the tension regulator or leveling equipment.

(ii) Description of the Prior Art

It is generally known that the rolled-down strip product suffers from such defects of distortion as a partial elongation appeared as edge-waves and center buckles of a strip, and as a partial bending appeared as an L-shaped and C-shaped warpings, etc. It is naturally inevitable that such defects of distortion would not only spoil the appearance of the sheet products, thus degrading the commercial value of the product, but also hampering the efficiency of feed throughout the procedures of roll-down operation on the strip product, and thus eventually rendering an obstackle to the automation of the entire strip production line. Also, this defect would then bring a further cause of distortion in the subsequent secondary working procedures. In this connection, there have been proposed the introduction of a tension regulator or leveler in the attempt for the correction of such defects of distortion in the production of the strip product.

Referring first to FIG. 1, there is shown the general layout of the typical tension leveling equipment of conventional construction. As shown in this drawing figure, there are seen input bridle unit 3 and output bridle unit 4 provided on the input and output sides of a leveling mill 2, respectively, through which bridle units 3 and 4 an extension of strip 1 is fed under tension in the direction shown by arrows. By aid of a plurality of working rolls 5, 6, 7, 8 and shift rolls 9, 10 which are arranged vertically in a zigzag fashion above and below the extension of the strip 1 along the longitudinal direction of the entire leveling mill 2, the strip 1 is subjected in sequence to the repeated procedures of bending throughout the whole extension of the leveling mill 2. With this sequence of procedures, the strip 1 is rendered the permanent elongation which is required for smoothing out its distortion, thus finishing the due correction of distortion involved in the strip 1, accordingly.

It is of the general practice that among the series of rolls provided in the leveling mill 2, those rolls as disposed above and along the extension of strip 1, that is, a unit of work roll 5 and paired back-up rolls 5*a*, a work roll 7, a pair of deflector rolls 8*a* and a shift roll 9 are fixed in their vertical positioning on one hand, and that those as disposed below and along the extension of strip 1, that is, a unit of work roll 6 and its paired back-up rolls 6*a*, a pair of deflector rolls 7*a*, a work roll 8 and a shift roll 10 are respectively mounted shiftably up and down by way of such elevating units 11, 12, 13, 14 as, for instance, an electrically operated jack, on the other hand. With this arrangement, these rolls 6, 6*a*, 7*a* 8 and 10 are designed to be shiftable in their locations in the vertical directions so that the relationship of intermeshing thereof may be adjusted accordingly. Furthermore, it is arranged that the shift rolls 9 and 10 are mounted shiftably in the mutually opposite directions of their axes by aid of a roll shifting drive not shown. Further to such mounting for these shift rolls 9, 10, it is known as disclosed in the Japanese patent application Laid-open No. 153622/1980 that they are formed with crownings at one ends thereof in the mutually opposite positions, respectively, and that these rolls 9, 10 may be shifted mutually in the opposite directions along their axes in accordance with the width dimension, the mechanical property in the width and the distribution of thickness of the strip 1. This arrangement is designed specifically for the provision that the distance of the crowning portions of these rolls working upon the widthwise edges may be adjusted accordingly, thereby allowing the arbitrary changes of the distribution of tensions in the widthwise direction of the strip. In this drawing, there is also shown support rolls 15 and 16.

On the other hand, it is designed for rendering a required rate of elongation on the extension of strip 1 that there is given a difference in velocities of rotation of the both input and output bridle units 3 and 4 which corresponds to a predetermined extent of elongation. More specifically, the output bridle unit 4 is driven by a single main motor 17 through a bevel gear 18*a* and a pinion stand 19*a* provided for this particular bridle unit. At the same time, the input bridle unit 3 is arranged to be driven by one and the same main motor 17 through a pinion 20, a ring gear 21*a* of a planetary-gear unit 21, a bevel gear 18*b* connected operatively to the solar-revolution shaft 22 of the planet gear unit and through a pinion stand 19*b*. Also, a stretching motor 23 which is a direct current motor is connected operatively to a solar gear of the planetary gear unit 21. With such arrangement, it is designed to obtain a required difference in the circumferential velocities of the both input and output bridle units 3, 4 through the control of the rotating speed of this stretching motor 23, accordingly. There are also shown slipping clutches 24 provided in each of the pinion stands 19*a* and 19*b*, respectively.

It is also shown that this stretching motor 23, each of the elevating units 11, 12, 13, 14 noted above and the roll shifting drive are connected operatively to an operation processsor 25. The operation processor 25 is operated in processing of a given condition of specifications 26 such as the width, thickness and proof stress or yield strength, and the extent of edge-wave and center buckle of the strip 1, so that the amount of vertical shift (intermeshing) between the rolls 6, 6*a*, 7*a*, 8, 10, the amount of axial shift (extent of shifting) of the shift rolls 9, 10, the revolutionary velocity of the stretching motor 23 or the required rate of elongation of the strip 1 may be determined to be set.

As reviewed fully hereinbefore, it is known arranged in the conventional tension leveling equipment that the strip 1 is fed through the leveling mill 2 for the corrective procedures of its distortion, only after presetting such data as an extent of intermeshing and axial shift of the rolls involved and a required rate of elongation of the strip 1 in correspondence with a variety of given conditions of specification 26 on the strip 1 to be entered into the operation processor 25.

Recent years, however, the requirements for the improvement in the quality of the strip product have been growing more and more strict, and then this type of distortion removing process of the strip product by way of presetting the conditions such as the rate of intermeshing and the extent of vertical shifting of the rolls and the rate of elongation of a strip (which is called as the presetting control process) cannot meet such increasing requirements accordingly. More specifically, while there is given a coil of strip of an identical dimension, it is generally inevitable that there may exist a substantial struggling in the mechanical properties of a strip owing to the possible segregation of the chemical components in the longitudinal and widthwise directions thereof, in the irregular treating temperatures of the strip while in the rolling procedures, in the thickness dispersion of the strip, etc. As a consequence, therefore, there is available no effective means in correspondence to the fluctuations in such conditions as noted above for the due correction of distortions of the strip product with the conventional presetting control process.

SUMMARY OF THE INVENTION

The present invention is therefore materialized to practice in view of such circumstances and inconveniences as noted above. An object of the present invention is to provide an improved method of correcting the distortions existing in the strip product, which can afford an efficient distortion correction measure for the strip product with a high precision following closely a variety of fluctuations in the physical properties of the strip product.

According to the above-mentioned object of the present invention, there is provided, as summarized, an improved method of correcting distortions existing in the strip product by using a tension leveling equipment including a leveling mill station for smoothing out distortions remained in the strip product by producing a permanent elongation through the repetition of bending procedures rendered upon the strip while passing under tension therethrough, a pair of bridle units disposed on the both input and output sides of the leveling mill station, and means for rendering a tension upon the strip from a predetermined rate of elongation under the effect of a difference in the feeding velocities of the bridle units, which comprises the steps of detecting the distortions in the shape of the strip product upon the delivery thereof from the output bridle unit, obtaining detection signals, and controlling the rate of intermeshing in the leveling mill station and the rate of elongation of the strip product to a required range in accordance with the detection signals.

By the provision of such an advantageous construction as noted above, there may be attained the following effect according to the present invention.

That is, when applying in practice the improved tension leveling equipment embodying the present invention to the correction of the distortions existing in the strip product, it can afford a high precision correction of distortions in the strip product, following closely the possible fluctuations in the physical conditions which are generally particular to the strip product, thus making it possible in practice to obtain a high-quality strip product, accordingly.

Additional features and advantages of the invention will now become more apparent to those skilled in the art upon consideration of the following detailed description of a preferred embodiment exemplifying the best mode of carrying out the invention as presently perceived. The detailed description refers particularly to the accompanying drawings, in which like parts are designated at like reference numerals.

DETAILED DESCRIPTION OF A PREFERRED EMBODIMENT

Figure 1:
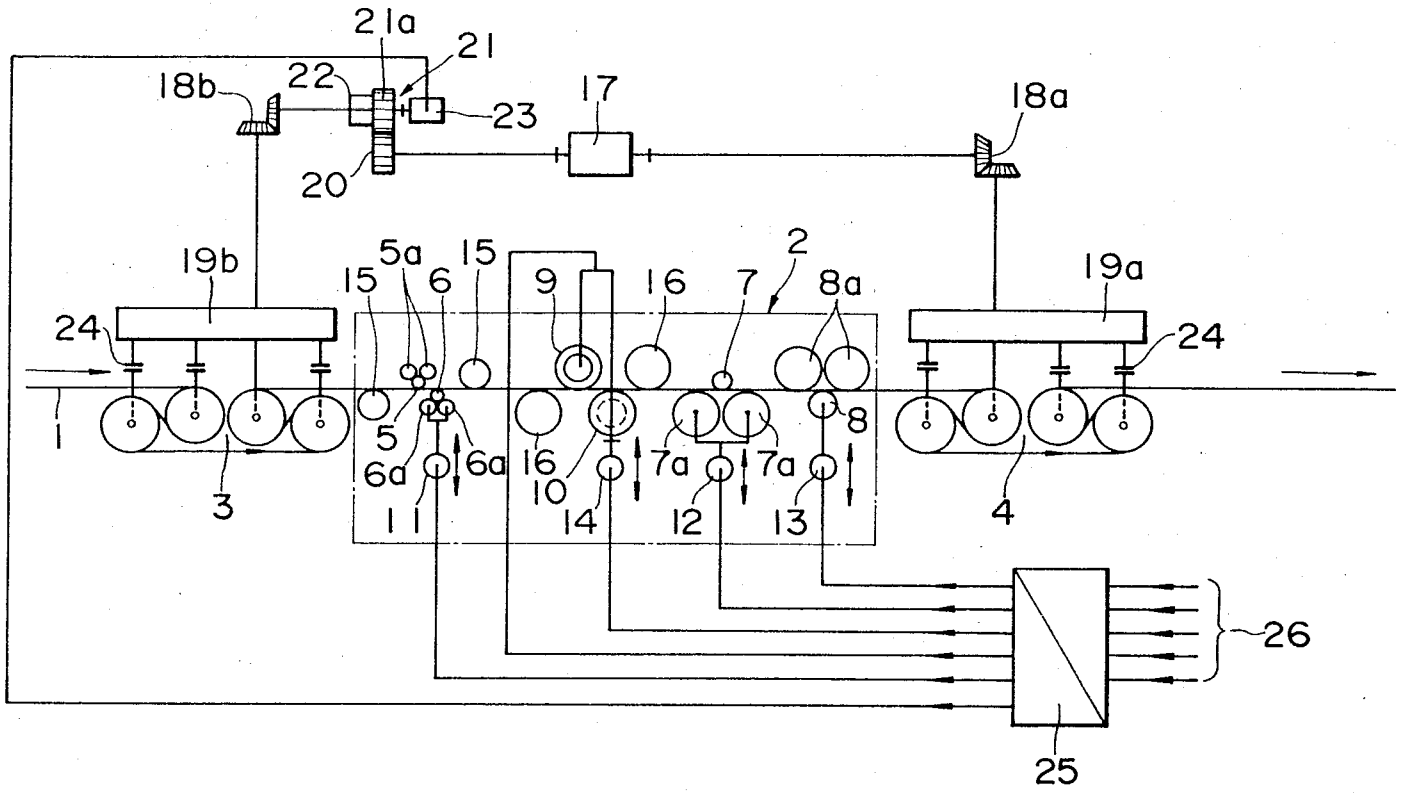
FIG. 1 is a schematic general view showing the general construction of a typical conventional tension leveling equipment.
Figure 2:
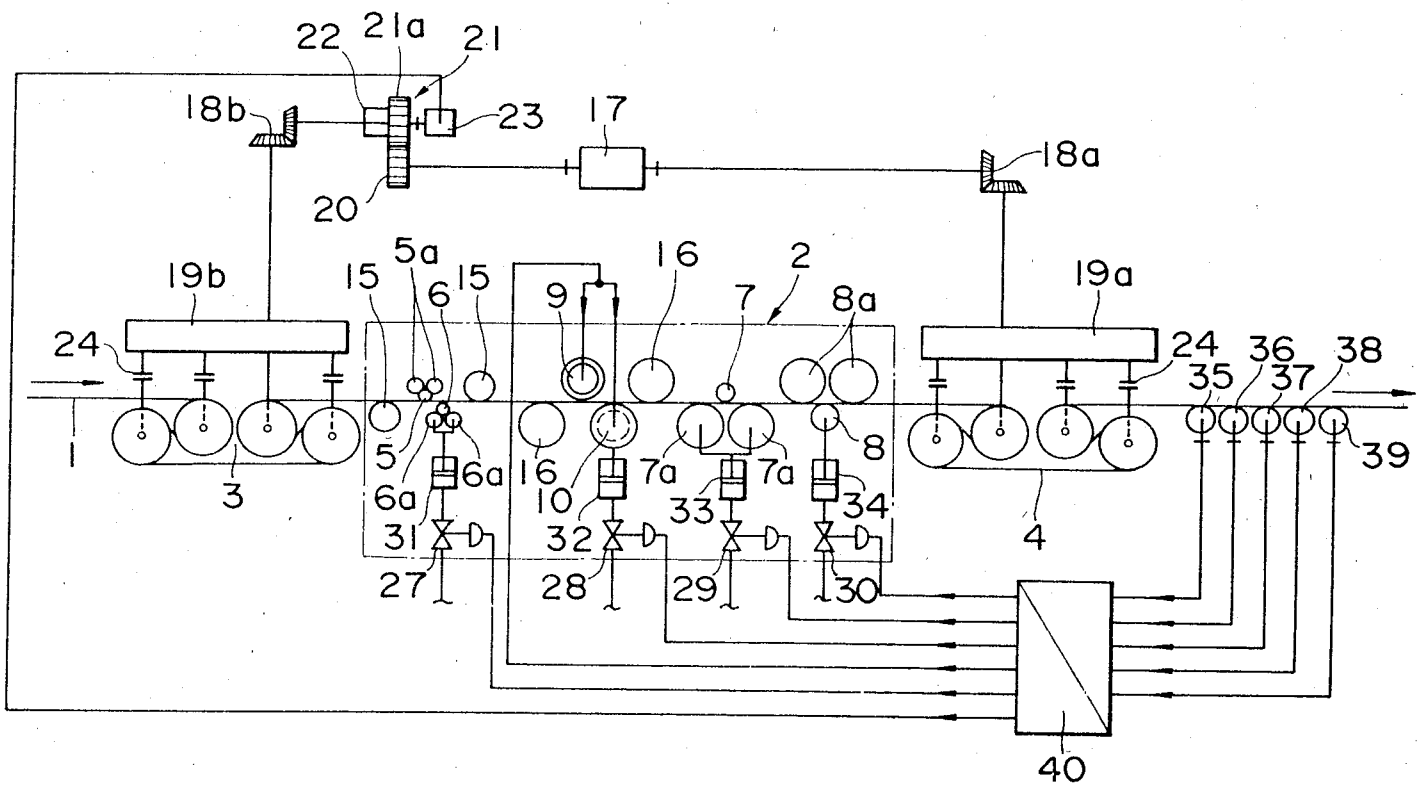
FIG. 2 is a similar schematic view showing the general construction of a preferred embodiment of the invention.

The present invention will now be explained in concrete terms by way of a preferred embodiment. Referring now to FIG. 2, which shows the general construction of a tension leveler in practice of the improved method of correcting distortions in the strip product according to the present invention, and in which like reference numerals designate like parts as in FIG. 1 and the description for such like and overlapped parts will be omitted for the avoidance of a verbosity.

Referring to FIG. 2, it is schematically shown that a series of rolls disposed in a serial fashion below the extension of a strip 1 fed under tension through the longitudinal extension of a leveling mill 2, that is, a unit of a working roll 6 and its complementary pair of backup rolls 6*a*, a shift roll 10, a pair of deflector rolls 7*a* and a working roll 8 are connected operatively to an elevating unit which comprises a series of servo valves 27, 28, 29 and 30 and a corresponding series of hydraulic cylinders 31, 32, 33 and 34, respectively.

Also, there are arranged sequentially a series of detecting units near the delivery side of the output bridle unit 4 for the detection of distortions existing in the strip 1, which comprise a flatness detector 35, a detector for detecting C-shaped warping 36, a detector for detecting L-shaped warping (so-called bowing) 37, an edge-waving detector 38, a center buckle detector 39, and the like. With these detecting units, such factors as the flatness, warping, and partial elongation of a strip product may be detected upon the passage of the strip 1 through the output bridle unit 4, from which there are obtained respective detection signals which are to be inputted into an operation processor 40. On the other hand, there are connected operatively on the output of the operation processor 40 the servo valves 27, 28, 29 and 30, a series of roll shift actuators like electrically-operated jacks not shown, and the stretching motor 23, respectively, so that the operation processor 40 may process the detecting signals from each of the detectors 35 through 39 for detecting distortions in the strip 1 for obtaining output signals from the operation processor, upon which these servo valves 27 through 30, electric motors for the roll shifting units, and the stretching motor 23 are controlled respectively, so that such operating factors as the rate of intermeshing of the leveling mill 2, the extent of vertical shift of the shift rolls 9, 10, and the required rate of elongation of the strip 1 may eventually be controlled accordingly, while passing through the leveling mill 2.

In operation to have the distortions existing in the strip 1 smoothed out with such construction as explained above, after having the settings of such factors of operation as the rate of intermeshing in the leveling mill 2, the vertical shift rolls 9, 10, and as the rate of elongation of the strip 1 in accordance with the operating specifications (such as the width and thickness, the proof stress or yield strength, the allowance for edge-waves and center buckles) of a strip product, the strip is then fed passing through the leveling mill 2 in the longitudinal direction thereof. Then, while passing therethrough, the strip 1 is continuously or intermittently subjected to the detection for the flatness, warpings, and edge-waves and center buckles of the strip by way of a series of detectors 35 through 39, and detection signals are obtained from these detectors so that these signals are fed into the operation processor 40. The corresponding outputs are obtained from this operation processor in accordance with the given conditions for correcting the distortions in the strip product, which will continuously or intermittently be fed back to each of the leveling mill 2 and the bridle units 3, 4 so that the strip 1 may be corrected duly of its distortions left therein on the basis of the preset rate of intermeshing, extent of vertical shifting and rate of elongation of the strip product, accordingly.

In connection with the detection procedures as stated above, while the response to the preset factors corresponding to the detection signals from each of the detectors 35 through 39 is then of an interest in practice, there is attainable a ready and satisfactory response by virtue of the employment of the efficient elevating mechanism comprising the servo valves 27 through 30 and the hydraulic cylinders 31 through 34 according to the preferred embodiment of the present invention.

While the present invention has been described in detail by way of one preferred embodiment thereof it is practiced in the tension leveling mill having the typical roll arrangement, it is to be understood that the present invention is not intended to be restricted to the details of the specific constructions shown in the preferred embodiment, but to contrary, the present invention can of course be adapted in the tension leveler incorporating other roll arrangement to an equal advantageous effect in accordance with the foregoing teachings without any restriction thereto and without departing from the spirit and scope of the invention.

It is also to be understood that the appended claims are intended to cover all of such generic and specific features particular to the invention as disclosed herein and all statements relating to the scope of the invention, which as a matter of language might be said to fall thereunder.

What is claimed is:

1. A method of correcting distortions existing in a rolled strip product by using a tension leveling equipment including a leveling mill station for smoothing out distortions remained in the strip product by producing a permanent elongation through the repetition of bending procedures rendered upon the strip while passing under tension therethrough, a pair of bridle units disposed on the both input and output sides of said leveling mill station, and means for rendering a tension upon the strip from a predetermined rate of elongation under the effect of a difference in the feeding velocities of said bridle units, which comprises the steps of detecting the distortions in the shape of said strip product upon the delivery thereof from said output bridle unit, obtaining detection signals, and controlling the rate of intermeshing in said leveling mill station and the rate of elongation of said strip product to a required range in accordance with said detection signals.

2. The method of correcting distortions in the strip product as claimed in claim 1, wherein the detection of distortions in the shape of said strip product performed upon the delivery of said strip from the output side bridle unit is directed to the flatness, the warping, and the partial elongating of said strip.

* * * * *